US006796258B2

(12) United States Patent
Chaix

(10) Patent No.: US 6,796,258 B2
(45) Date of Patent: Sep. 28, 2004

(54) BALANCING DEVICE FOR LOW TONNAGE SHIPS

(75) Inventor: Jean Edmond Chaix, Pierrevert (FR)

(73) Assignee: Societe Technique pour l'Energie Atomique TECHNICATOME, Gif sur Yvetter Cedex (FR)

( * ) Notice: Subject to any disclaimer, the term of this patent is extended or adjusted under 35 U.S.C. 154(b) by 0 days.

(21) Appl. No.: 10/272,779

(22) Filed: Oct. 17, 2002

(65) Prior Publication Data

US 2003/0075093 A1 Apr. 24, 2003

(30) Foreign Application Priority Data

Oct. 18, 2001 (FR) ..... 01 13430

(51) Int. Cl.[7] ..... B63B 39/02
(52) U.S. Cl. ..... 114/124
(58) Field of Search ..... 114/121, 122, 114/124

(56) References Cited

U.S. PATENT DOCUMENTS 3,426,718 A * 2/1969 Slager et al. ..... 114/124
3,442,243 A * 5/1969 Tanner ..... 114/124
4,014,280 A 3/1977 Laxo
5,379,713 A * 1/1995 Fujimura ..... 114/122
5,713,163 A 2/1998 Mutaguchi et al.
6,349,660 B2 * 2/2002 Chaix ..... 114/124

FOREIGN PATENT DOCUMENTS

| | | |
|---|---|---|
| DE | 2 322 778 | 9/1975 |
| DE | 349886 | 3/1992 |
| FR | 2 802 504 | 12/1999 |
| FR | 2 802 891 | 12/1999 |
| GB | 2 248 218 A | 4/1992 |

* cited by examiner

*Primary Examiner*—Andrew Wright
(74) *Attorney, Agent, or Firm*—Pearne & Gordon LLP

(57) ABSTRACT

The balancing device makes it easy to balance low and medium tonnage ships without needing to use high power. It comprises mainly one or several trains of moving masses mounted on a U track of which the side branches are parallel to the side walls of the ship, the central segment being perpendicular to the center line of the ship. Two drive wheels placed inside the turning points of the U enable driving of the train of moving mass. Application to low and medium tonnage ships.

7 Claims, 5 Drawing Sheets

BALANCING DEVICE FOR LOW TONNAGE SHIPS

SCOPE OF THE INVENTION

This invention relates to the domain of balancing low and medium tonnage ships such as launches, and particularly balancing in roll, in other words in list.

PRIOR ART AND PROBLEM THAT ARISES

Figure 1:
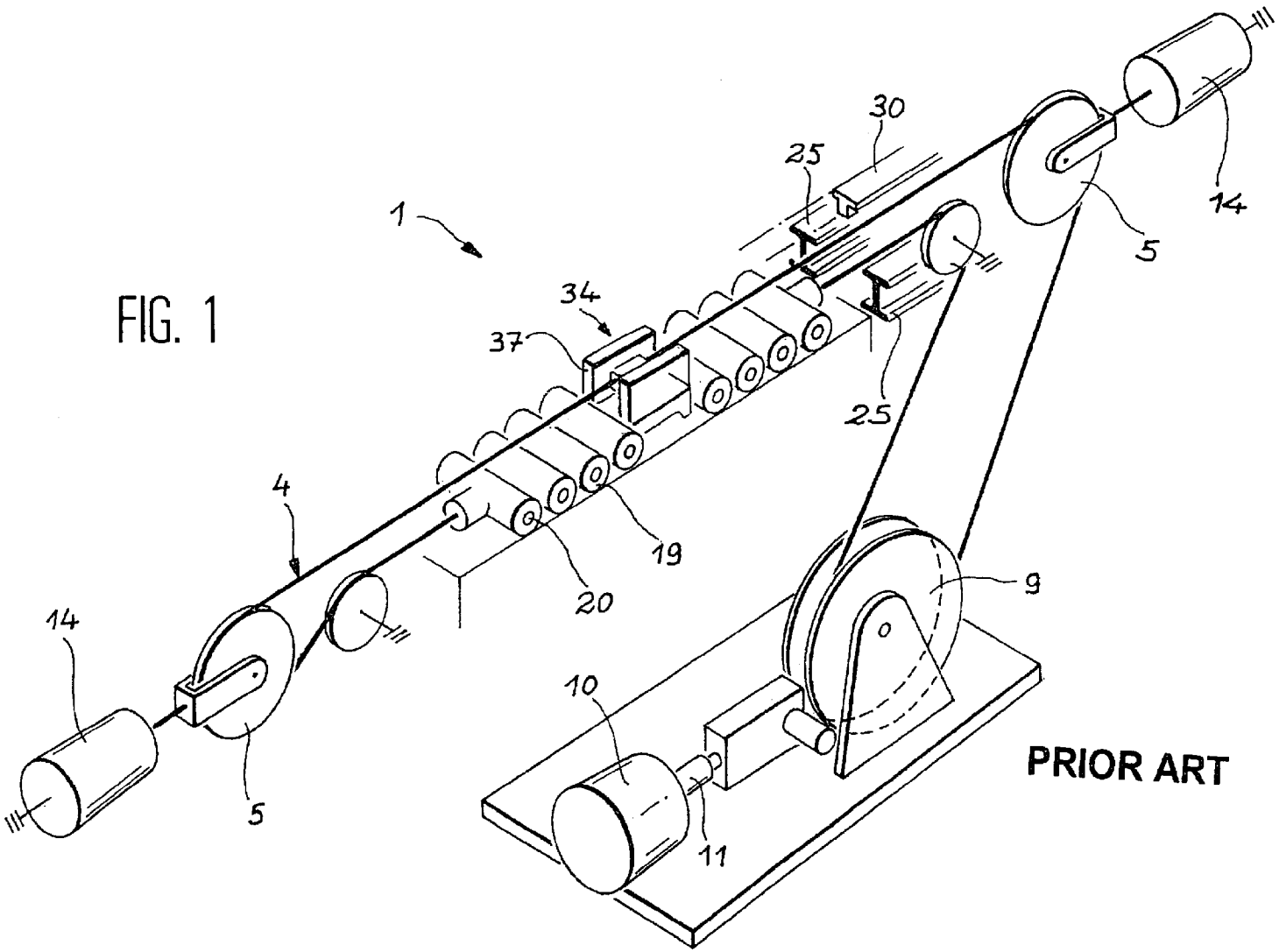

French patent application 2 687 978 deposited by the same applicant describes a device for balancing a ship, particularly for balancing in roll, using a track along which a train of solid weights can move. With reference to FIG. 1 reproducing the system used in this document, the balancing elements are composed of two trains of series of rollers 19 rolling along a track, for example composed of two side rails 25 and 26. A cable 4 driven by a motor 10 through a motor driven drum 9, displaces the rollers 19 on each side of the ship. A blocking system 34 fixing the position using two jaws 37 is placed between the two series of rollers 19, and is controlled by the cable 4. The assembly is fixed in place by bringing the jaws 34 close into contact with a central positioning rail 30 placed longitudinally above the device. When the cable is not tight, the jaws 34 clamp the central positioning rail 30. Two electrical lateral jacks 14 are also used on this device to tension the cable at its two ends through a pulley 5 fixed to the jack rod. Several of these devices may be mounted in parallel to each other in the compartments of the same ship, forming part of the ship deck structure.

It is easy to understand that when the cable is tensioned, the two clamping jaws 37 move apart from each other to release the device from the central positioning rail 30. The set of rollers 19 can then be moved by applying tension to one or the other end of the cable 4. If the tension is removed deliberately or accidentally by the breakage of a strand of the cable 4, the clamping jaws 37 will automatically be blocked in contact with the central positioning rail 30, in the closed position.

Figure 2:
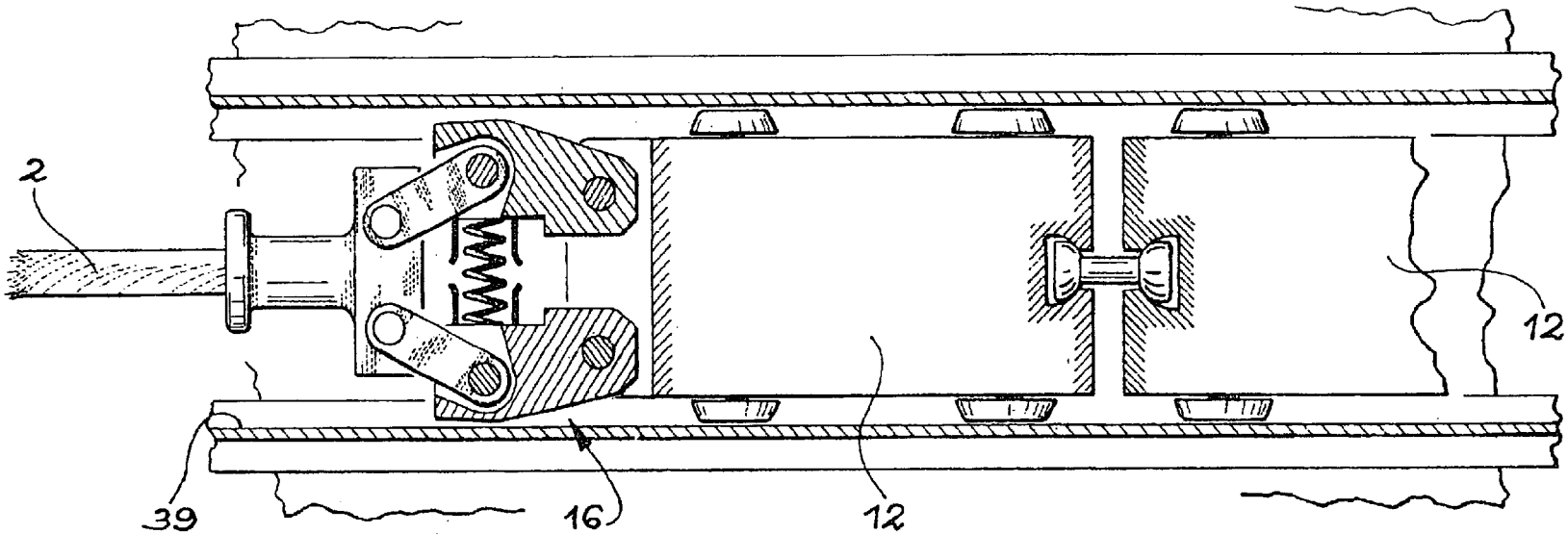
PRIOR ART FIG. 2

Furthermore, French patent application 2 802 504 deposited by the same applicant describes an improvement to this device as shown in FIG. 2. It also comprises a set of moving lead masses 12, together with a pair of jaws 16 at each end bearing on the side rails of a compartment. A single cable 2 pulls the train and controls loosening of the jaws 16.

These ship balancing devices are adapted for high tonnage ships. Application of these devices to medium tonnage and particularly to low tonnage ships would cause a significant loss of volume inside the ship, due to their size. Furthermore, the cable winch control system and the cable tension control system are relatively sophisticated and are not necessary in low tonnage ships. Therefore, the purpose of the invention is to overcome these disadvantages by proposing another ship balancing device applicable to and adapted to low tonnage ships.

SUMMARY OF THE INVENTION

Therefore, the main purpose of the invention is a device for balancing a ship, particularly in roll, comprising:

- a train of rolling moving masses forming the links of a chain forming a train;
- train immobilization means;
- a train tension and immobilization means control cable;
- at least one motor to activate the train; and
- means of adjusting the cable tension in order to control the immobilization means and comprising two moving pulleys to adjust the cable tension.

According to the invention, the moving masses are preformed so that they can wind around at least one drive wheel with teeth that engage in the corresponding complementary housings machined on the side of the moving masses, each of these moving masses rolling on at least two side rails on at least four rollers, the at least two rails forming a U track with two lateral branches each extending along a wall of the ship, and a central horizontal segment, the at least one drive wheel being located inside the turning point formed by the central segment and a first of the two side segments.

In a first preferred embodiment of the invention, it comprises two chain drive wheels, the second being located at the second turning point formed by the central segment and the second of the two side branches.

In one particular embodiment of the invention, the rails are composed of two opposite sides of a section.

In a first embodiment of the invention, the side branches are horizontal, in other words the U formed by the track composed of the two rails is horizontal.

In this case, the moving masses preferably have four wheels and the track is composed of two side rails.

In a second embodiment of the invention, the side branches are vertical, each of the rails is composed of a vertical compartment, in other words the U formed by the track composed of the rails is vertical.

Consequently in this case, the moving masses preferably have eight wheels rolling in sets of four on two inside faces of two opposite sides of the compartment.

LIST OF FIGURES

Figure 3:
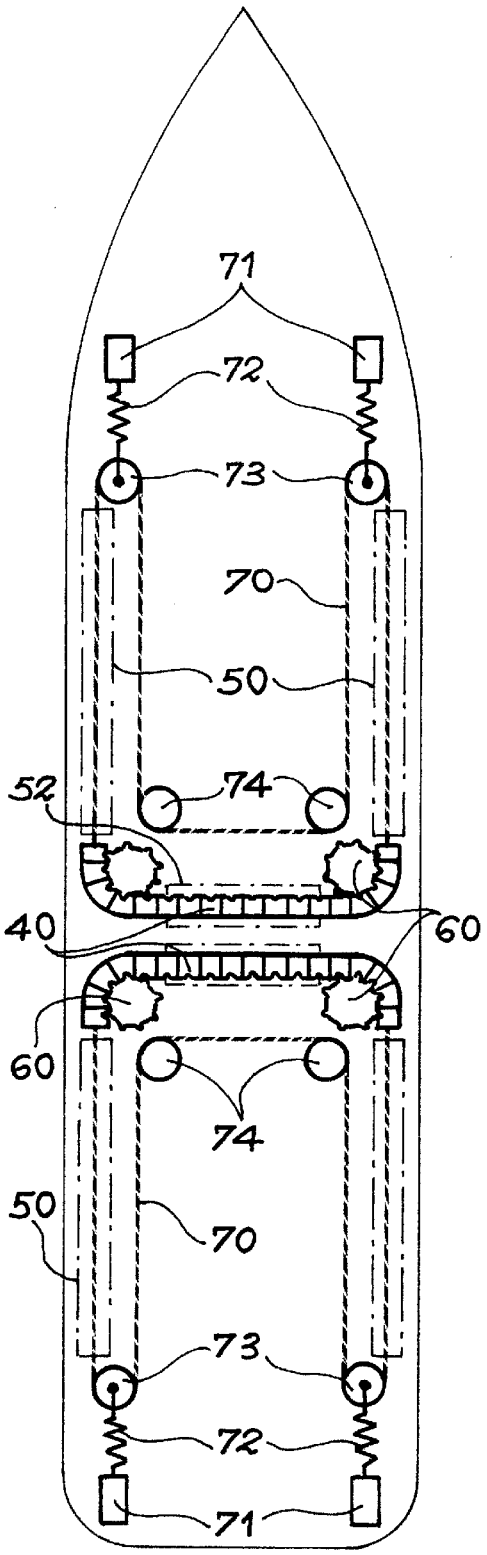
Figure 4:
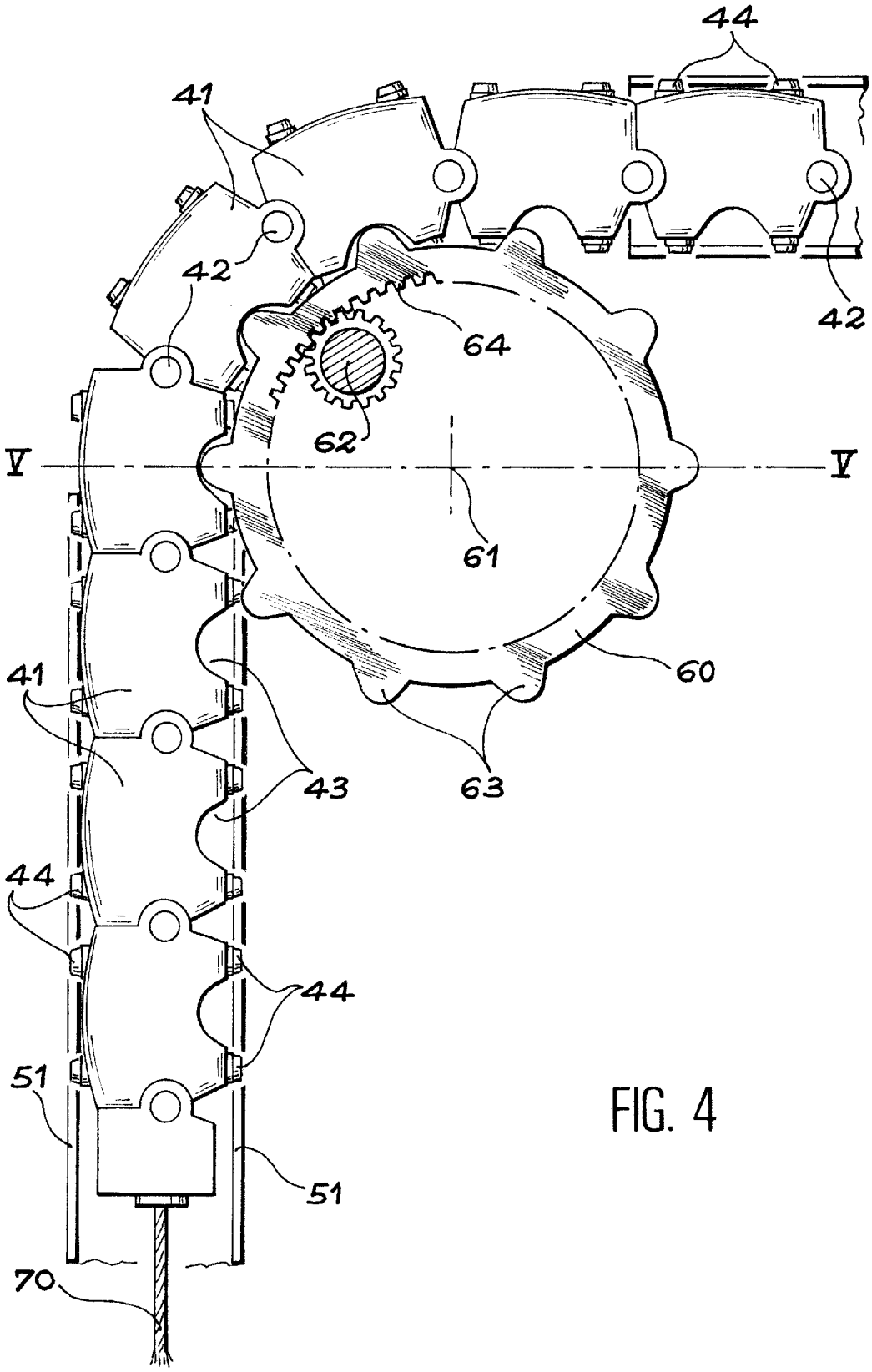
Figure 5:
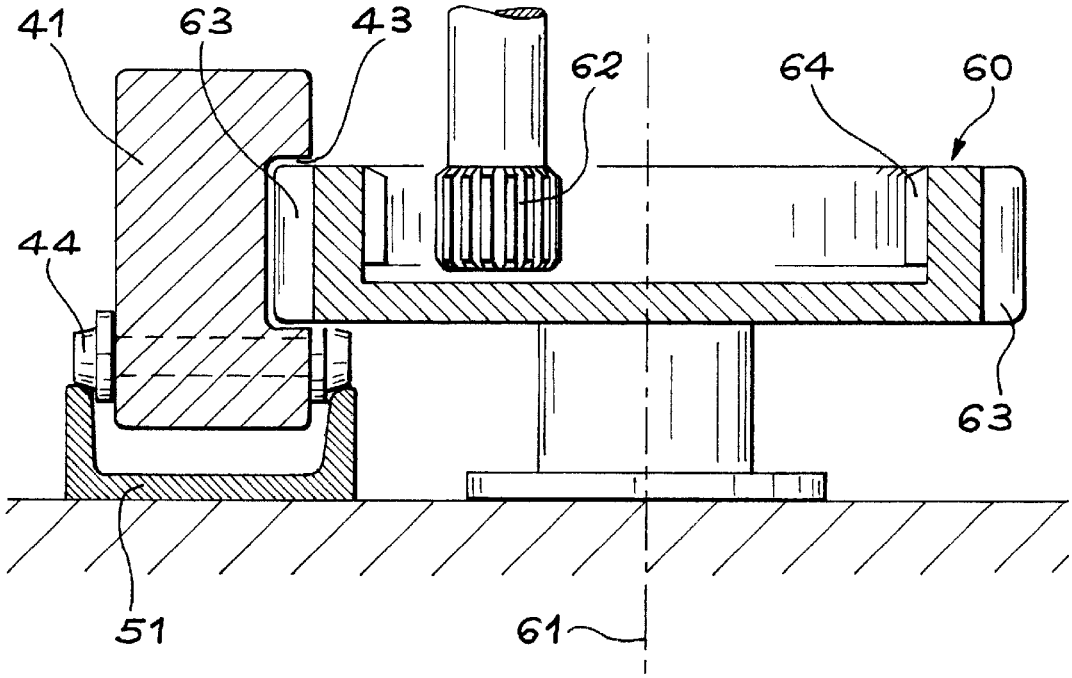

The invention and its technical characteristics will be better understood after reading the following description accompanied by several figures:

FIG. 1, already described, showing an exploded view of a first balancing device according to prior art;

FIG. 2 showing a top view of part of a second balancing device according to prior art;

FIG. 3, showing a first manner by which the device according to the invention may be installed in a ship;

FIG. 4, showing a detail of the construction of this first version of the invention;

FIG. 5, showing a section through the detail in FIG. 4; and

Figure 6:
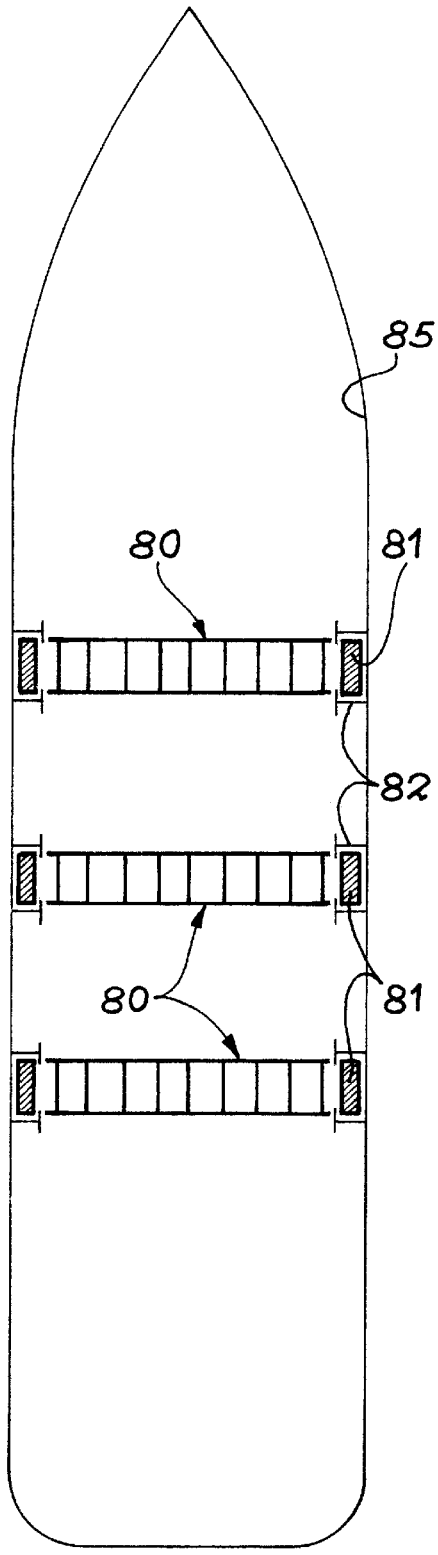

FIG. 6, showing a top view of a second manner in which the device according to the invention may be installed in a ship.

DETAILED DESCRIPTION OF THE INVENTION

The device according to the invention is still based on a train system formed by individual rolling blocks each composed of a mass that moves from one side of the ship to the other.

FIG. 3 contains a top or bottom view, showing how the device according to the invention must be installed. It can be seen that the train of moving masses moves along a U track. This track is placed horizontally in the ship, so that the two side branches 50 of the U are parallel to and close to the edges of the ship, in other words each is in contact with an inside wall of the ship. A central segment 52 connects the two side branches 50 of the U. The angle between the two side branches 50 and the central segment 52 of the track is 90°. In order to form the corresponding turning point, there are two sprocket wheels 60, at least one of which and preferably both are driving wheels, and around which the masses train 40 will wind when it moves from the central segment 52 to one of the two side branches 50.

Movements of the train 40 are controlled using the drive wheels 60. A tension cable 70 connects the two ends of the train 40. Its circuit is composed of a loop that is closed and forms a U inside the circuit followed by the train 40. The cable is tensioned at the ends of the two side branches 50 of the U by a mobile pulley 73 around which the cable 70 makes a half turn. In its inner path, the cable 70 makes the U trajectory around two inside detour wheels 74. The mobile pulleys 73 are held in place elastically, each using a tension jack 71, through a spring 72. Thus, the cable is held at a given tension, depending on whether the train 40 must be immobilised or displaced.

Indeed, an increasing the tension in the cable 70 can loosen the train immobilisation system 40. In this case, rotation of the drive wheels 60 enables the train 40 to move along the three parts 50 and 52 of the U. If the tension in cable 70 is released, then the train 40 can be blocked in the required position once it reaches it, by relaxation of the clamping system which returns to its natural blocking position. Details of operation of this system are described in detail in French patent application published under number 2 802 504.

Two systems are shown in the same ship in FIG. 3. This is simply one example embodiment, and a single system, or more than two systems, could be installed inside the same ship.

FIG. 4 shows in detail of part of the path of the moving masses train, particularly around a drive wheel 60. The drive wheel is shown with a given number of teeth 63 projecting outside the wheel. There is a toothed ring 64 on the inside of the drive wheel 60, within which a drive pinion 62 engages with a much smaller number of teeth than in the inner ring 64, in order to form a reduction gear.

The different moving masses 41 forming the train are attached to each other by a linking pin 42 around which each can pivot with respect to each other. They thus form part of a long chain that can be pulled to one side or the other. Each moving mass 41 on each side of the drive wheel 60 possesses a housing 43, the shape of which corresponds to the shape of the teeth 63 of the drive wheel 60, and more precisely corresponds to the movement of each tooth 63 in each cavity 43, while the moving masses 41 pivot about the turning point around which the train passes. When the moving mass train 41 moves around the drive wheel 60, each moving mass 41 pivots by 90° so that it can pass from one of the side branches 50 to the central horizontal segment 52.

Two opposite sides of a section are used to guide each moving mass 41 during its displacements along the side branches and the horizontal segment. Four rollers 44 on each moving mass 41 roll along these two opposite sides. Thus, the sections act as rails for the moving masses train 41.

FIG. 5 shows a section along line V—V in FIG. 4, and gives a better view of how these moving masses are arranged. This figure shows the rollers 44 rolling along the top of the opposite sides 51 of the section and installed free to rotate in the base of a moving mass 41. This FIG. 5 also shows a tooth 63 of the drive area 60 that penetrates into the corresponding housing 43 of the moving mass, the drive gear 62 and the inner ring 64 of the same drive wheel 60.

FIG. 6 shows a second way of installing the device according to the invention in a ship. In this case, the said devices 80 have been installed. The main difference compared with the installation described with reference to the previous figures, is that the side branches are placed vertically. It can be observed that side compartments 82 are located on the inside wall 85 of the ship's hull. Each surrounds a moving mass 81 symbolising the train of circulating moving masses. Note that in this version eight rollers are essential for support on both sides of the side compartments 82. Note that in this installation mode, the motor drive must be slightly more powerful to take account of the weight of the moving masses 81 that have to be installed on the inside of the side compartments 82.

In the two embodiments described, it is useful to be able to drive the drive wheels 60 using reversible hydraulic motors powered by a pressure generation system capable of supplying the power necessary for acceleration and starting, and for storing braking energy. The hydraulic motors can be recharged at any time by a pump. The fact that two drive wheels 60 are used means that the drive system can be made redundant if there is a deficiency of a failure in either of them.

What is claimed is:

1. Device for balancing the roll of a ship, comprising:

a train (40) of rolling moving masses (41, 81) forming the links of a chain forming the train;

immobilisation means for the train (40);

a cable (70) applying tension to the train and controlling the immobilisation means;

at least one motor drive to activate the train (40); and means of adjusting the tension of the cable (70) in order to control the immobilisation means and comprising two moving pulleys (73) to adjust the cable tension, characterised in that the moving masses (41, 81) are preformed so that they can wind around at least one drive wheel (60) with teeth (63) that engage into corresponding and complementary housings (43) machined on the sides of the moving masses (41, 81), each moving mass rolling on at least two side rails (51), using at least four rollers (44), the at least two side rails (51) forming a U-track with two side branches (50) each extending along one wall of the ship and a central horizontal segment (52), the at least one drive wheel (60) being located on the inside of a turning point formed by the central segment (52) and a first of the two side branches (50).

2. Device according to claim 1, characterized in that it comprises two drive wheels (60) each placed at a turning point formed by the two side branches (50) and the central horizontal segment (52).

3. Device according to claim 1, characterized in that the rails (51) are formed by the two opposite sides of a section.

4. Device according to claim 3, characterized in that the side branches (50) are horizontal.

5. Device according to claim 4, characterized in that each moving mass (41) has four rollers (44) rolling on the two side rails (51).

6. Device according to claim 3, characterized in that the side branches are vertical and each rail is composed of a compartment (82).

7. Device according to claim 6, characterized in that each moving mass (81) has rollers rolling in sets of four on the two inside faces of two opposite sides of the compartment (82).

* * * * *